US010105271B2

(12) United States Patent
Sang et al.

(10) Patent No.: US 10,105,271 B2
(45) Date of Patent: Oct. 23, 2018

(54) INNER BOWL OF OPERATING HEAD OF NURSING MACHINE, AND NURSING MACHINE

(71) Applicant: SUZHOU ALTON ELECTRICAL & MECHANICAL INDUSTRY CO., LTD., Jiangsu (CN)

(72) Inventors: Shuhua Sang, Jiangsu (CN); Weidong Lu, Jiangsu (CN); Fengqiang Yuan, Jiangsu (CN); Qiang Song, Jiangsu (CN); Zhouen Li, Jiangsu (CN)

(73) Assignee: SUZHOU ALTON ELECTRICAL & MECHANICAL INDUSTRY CO., LTD. (CN)

( * ) Notice: Subject to any disclaimer, the term of this patent is extended or adjusted under 35 U.S.C. 154(b) by 2 days.

(21) Appl. No.: 15/301,550

(22) PCT Filed: Apr. 3, 2015

(86) PCT No.: PCT/CN2015/075853
§ 371 (c)(1),
(2) Date: Oct. 3, 2016

(87) PCT Pub. No.: WO2015/149716
PCT Pub. Date: Oct. 8, 2015

(65) Prior Publication Data

US 2017/0020760 A1 Jan. 26, 2017

(30) Foreign Application Priority Data

Apr. 4, 2014 (CN) ..... 2014 2 0163666 U
Apr. 4, 2014 (CN) ..... 2014 2 0163938 U
(Continued)

(51) Int. Cl.
*A61G 9/00* (2006.01)
*A47K 10/48* (2006.01)
(Continued)

(52) U.S. Cl.
CPC ..... *A61G 9/006* (2013.01); *A47K 10/48* (2013.01); *A61G 9/003* (2013.01); *E03D 9/08* (2013.01); *E03D 11/02* (2013.01)

(58) Field of Classification Search
CPC ..... A61F 5/451; A61G 7/047; A61G 7/02; A61G 7/0005; A61G 9/00; A61G 9/003; A61G 9/006; A61G 9/02
See application file for complete search history.

(56) References Cited

U.S. PATENT DOCUMENTS 4,316,077 A * 2/1982 Carlson ..... A45D 20/12 165/103
5,848,222 A * 12/1998 Jung ..... F24H 1/18 222/146.5
(Continued)

FOREIGN PATENT DOCUMENTS

CN 101099708 1/2008
CN 101589981 12/2009
(Continued)

OTHER PUBLICATIONS

International Search Report, dated Jul. 8, 2015, for PCT Application No. PCT/CN2015/075854.
(Continued)

*Primary Examiner* — Erin Deery
(74) *Attorney, Agent, or Firm* — Barnes & Thornburg LLP; Jeffrey R. Stone

(57) ABSTRACT

Disclosed is an inner bowl of a working head of a nursing machine, comprising a bowl body, a baffle, and a drying device; the front part of the bowl body is provided with a bowl mouth, the top surface of which is a horizontally arranged drain port, the bottom surface of which is an obliquely arranged U-shaped arc bottom, and both sides of the U-shaped arc bottom of which are uniformly provided with infrared-reflective feces sensors; the outer bottom sur-
(Continued)

face of the bowl body is provided with a urine sensor; the baffle is vertically arranged on the bowl body and is connected to the drain port; the drying device is arranged at the rear side of the bowl body, and an air outlet of the drying device is arranged on the rear side wall of the bowl body below the baffle. Also disclosed is a nursing machine.

2 Claims, 15 Drawing Sheets

(30) Foreign Application Priority Data

| | | |
|---|---|---|
| Apr. 4, 2014 | (CN) | 2014 2 0164423 U |
| Apr. 4, 2014 | (CN) | 2014 2 0164496 U |
| Apr. 4, 2014 | (CN) | 2014 2 0164829 U |
| May 26, 2014 | (CN) | 2014 2 0271940 U |

(51) Int. Cl.
*E03D 9/08* (2006.01)
*E03D 11/02* (2006.01)

(56) References Cited

U.S. PATENT DOCUMENTS

| | | | | |
|---|---|---|---|---|
| 6,021,529 | A * | 2/2000 | Abbato | A61G 9/006 4/144.1 |
| 6,128,790 | A * | 10/2000 | Brayda Di Soleto | A61G 7/02 4/480 |
| 6,394,988 | B1 * | 5/2002 | Hashimoto | A61F 13/84 604/327 |
| 8,191,181 | B2 * | 6/2012 | Nakamura | A61G 7/02 4/319 |
| 8,402,573 | B2 * | 3/2013 | Nakamura | A61G 9/00 4/144.1 |
| 9,032,563 | B2 * | 5/2015 | Lee | A61G 9/00 4/450 |
| 9,233,020 | B2 * | 1/2016 | Matsumiya | A61G 9/006 |
| 9,427,368 | B2 * | 8/2016 | Lee | A61G 9/003 |
| 2009/0193572 | A1 | 8/2009 | Nakamura et al. | |
| 2017/0172831 | A1 * | 6/2017 | Sang | A61G 9/00 |

FOREIGN PATENT DOCUMENTS

| | | | | |
|---|---|---|---|---|
| CN | 201356746 | | 12/2009 | |
| CN | 201790992 | | 4/2011 | |
| CN | 102293702 | | 12/2011 | |
| CN | 101912332 | | 6/2012 | |
| CN | 102525719 | | 7/2012 | |
| CN | 102920565 | | 2/2013 | |
| CN | 202892179 | | 4/2013 | |
| CN | 203075099 | | 7/2013 | |
| CN | 203829196 | | 9/2014 | |
| CN | 203829198 | | 9/2014 | |
| CN | 203829199 | | 9/2014 | |
| CN | 203829201 | | 9/2014 | |
| CN | 203829202 | | 9/2014 | |
| CN | 203829203 | | 9/2014 | |
| CN | 203829204 | | 9/2014 | |
| CN | 203829212 | | 9/2014 | |
| CN | 203885767 | | 10/2014 | |
| EP | 0494488 | A1 * | 7/1992 | A61F 5/451 |
| EP | 2087874 | | 8/2009 | |
| EP | 2087875 | | 8/2009 | |
| EP | 2428191 | | 3/2012 | |
| EP | 2556813 | | 2/2013 | |
| JP | 6014819 | | 1/1985 | |
| WO | 2006119873 | | 11/2006 | |

OTHER PUBLICATIONS

Extended European Search Report, dated Feb. 23, 2017, for PCT Application PCT/CN2015/075853.

Extended European Search Report, dated Mar. 10, 2017, for PCT Application No. PCT/CN2015/075854.

* cited by examiner

INNER BOWL OF OPERATING HEAD OF NURSING MACHINE, AND NURSING MACHINE

TECHNICAL FIELD

The present disclosure relates to the technical field of medical nursing appliances, and particularly to an inner bowl of an operating head of a nursing machine and a nursing machine.

BACKGROUND

With the development of people' living standards, sickbed patients unable to defecate and urinate by themselves due to cardiovascular and cerebrovascular diseases and other diseases are increasing year by year, which brings great pressure to the family and the society; the patients cannot defecate by themselves, so assistance from accompanying persons is needed; and however, the workload of the accompanying persons is increased due to uncertainty of a defecation time of the patients, and great pain and burden are brought to physiology and particularly spirit of the patients. Therefore, Accordingly, medical institutions and patients' families often use a special urination or defecation nursing machine to reduce the burden of nursing persons, thereby effectively improving a therapy environment of the patients. A common nursing machine comprises an operating head and a main unit, the operating head is used to suck sewage and clean lower body of the patient, and the operating head is provided with a rubber sheath attached to the patient and a passage inner bowl. Most of the passage inner bowls of the nursing machines currently on the market use flat bottoms with slope sides, and in use, a large amount of high-pressure water is needed to clean excreta when flushing. Further, sensors of the existing nursing machine are not reasonable in arrangement, easy of false triggering or failure of detection, often requiring manual intervention, and resulting in heavier burden of the accompanying and nursing persons.

The nursing machine needs to be dried after washing the lower body of the patient, the existing nursing machine uses a cooling fan on a sewage suction motor within the main unit as an air source, and the air flow is heated by a heater before blowing into a warm air port of the operating head. A long pipeline is connected between the main unit and the operating head, leading to the drying effect being not good, and toner generated by the motor brush will be blown to the patient together with the air flow. Further, an electric heating wire is provided at an air outlet of the operating head, however, rated power of the DC electric heating wire is limited, the heating effect being still poor. Therefore, it is necessary to improve the current nursing machine.

Structure and function of the existing nursing machine are not reasonable enough, and there are some problems in use. After the patient's excreta is collected by the operating head of the nursing machine, negative pressure is created in a sewage bucket by a negative pressure source, and then the excreta is sucked into the sewage bucket of the main unit through a sewage suction pipe. The odor in the sewage bucket discharges outwards during the extraction of the negative pressure source, influencing the environment. Although the bottom of the existing nursing machine generally is equipped with a deodorizing filter element, when replacing the filter element, the main unit needs to be flipped over, and installation and connection are too much cumbersome; and when the nursing machine is in standby state, the odor in the sewage bucket is likely to flow back into the operating head through the sewage suction pipe, thereby sending out to the room. Therefore, it is necessary to improve the current nursing machine to improve its performance.

When the nursing machine works, feces and urine as well as the defecation portion of the patient are washed with water, which requires a plurality of different sprayers to complete; a water tank is connected with the different washing sprayers through separate water pipes, and a solenoid valve or an electric valve is required as waterway selection device, however, due to the large volumes of the solenoid valve and the electric valve, they can only be arranged in the main unit together with the water tank. The distance between the main unit and the operating head is relatively far, and the sprayers are arranged in the operating head, so that long pipelines are needed between the water tank and the sprayers, increasing the risk of aging and leaking of the pipelines; when switching the pipelines, a large amount of water remains in the original pipeline, and then the water will wash the defecation portion of the patient in a cold water manner when working next time, causing discomfort of the patient's body.

The operating head is fitted over the lower body of the patient for collecting excreta, the operating head is provided with a water spray mechanism to wash the lower body of the patient and to clean interior of the operating head, and the operating head is also provided with a dryer for drying the lower body of the patient. The main unit is provided with a sewage suction device, a water supply device and a control processor, clean water is heated by the water supply device and then delivered to the water spray mechanism of the operating head through a water pump, and the excreta and the polluted water in the operating head are sucked under the vacuum effect of the sewage suction device. Thus the operating head and the various components of the main unit shall be connected by a polluted water pipe, a clean water pipe and electric circuits, which are penetrated through a connecting hose after being bundled, the connecting hose, the polluted water pipe, the clean water pipe and the electric circuits are connected at both ends to the main unit and the operating head, respectively; in order to prevent the connecting hose from disconnecting with the main unit and the operating head in use, most of the current connecting hoses are fixedly connected to the operating head and the main unit, so as to avoid the excreta and water inside the pipes from leakage caused by false movement and falling off. However, in the case that the patient does not need to wear the operating head, there is a problem of nowhere to place the operating head; moreover, even there is a problem of little leakage at joints, the operating head needs to be completely disassembled, causing a lot of trouble to detection and repair. Therefore, it is necessary to improve the current nursing machine in order to improve its performance.

The operating head is connected to the main unit through the connecting hose to collect the excreta and polluted water into a polluted water bucket. In general, a pipe fitting is fitted over the connection between the main unit and the hose and fixed with screws, or the hose is directly plugged to a joint of the main unit by means of elasticity of the hose. The existing two connections have such problems in use as being cumbersome in installation and connection, connection strength being not high, and being easy to fall off on its own, therefore, it is necessary to improve the current structure.

SUMMARY

An object of the present disclosure directs to the shortcomings and deficiencies of the prior art and is to provide an inner bowl of an operating head of a nursing machine and a nursing machine, with reasonable structure, being sensitive and accurate in response, being convenient for use, and having better usage effects.

In order to achieve the above object, the following technical solution is used in the present disclosure:

An inner bowl of an operating head of a nursing machine of the present disclosure comprises a bowl body, a baffle and a drying device, a wedge-shaped bowl mouth is provided at a front portion of the bowl body, a top surface of the bowl mouth is a horizontally arranged drain port, and a bottom surface of the bowl mouth is an obliquely arranged U-shaped arc bottom, both sides of the U-shaped arc bottom of the bowl mouth are provided with reflective infrared feces sensors, an outer bottom surface of the bowl body is provided with a urine sensor; the baffle is vertically arranged on the bowl body and connected to the drain port, being integrally disposed, the drying device is provided at a rear side of the bowl body, and an air outlet of the drying device is located on a rear sidewall of the bowl body below the baffle.

Further, a plurality of sensing probes are provided for the feces sensors, and the plurality of sensing probes are arranged from front to back along the sides of the bowl mouth and correspond to different bottom regions of the bowl mouth.

Further, two metal probes are provided for the urine sensor, the two metal probes penetrate and protrude from the bottom surface of the bowl body, and a boss is provided in the bottom surface of the bowl body between the two metal probes.

Further, a left and a right sprayers are provided at both sides of the bowl mouth, and the sprayers are disposed horizontally below the drain port.

Further, the drying device comprises a drying device housing, a fan and a PTC heating wire, the air outlet at the front end of the drying device housing is connected to the rear sidewall of the bowl body, the PTC heating wire is provided in a front portion of the drying device housing, and the fan is provided in a tail portion of the drying device housing.

A nursing machine is further provided, comprising a main unit and an operating head, wherein the operating head uses the above-mentioned inner bowl.

Further, the operating head comprises an operating head housing, the horn-shaped inner bowl is provided in the operating head housing, an upper end of the operating head housing is provided with a sheath connected to a large opening end of the inner bowl; the drying device, i.e., a warm air blower, is provided in the operating head housing, the air outlet of the drying device is connected with the inner bowl, and the main unit is provided with a control system, which is electrically connected with the drying device.

Further, the drying device comprises a volute-shape drying device housing, a PTC heating wire and a fan, a front end of the drying device housing is connected to the air outlet, the PTC heating wire is provided in the drying device housing, the fan is provided in a tail end of the drying device housing, and the PTC heating wire and the fan are separately electrically connected with the control system.

Further, a hose is provided between the operating head housing and the main unit, a control line connected to the control system is provided in the hose, and the control line is connected to the PTC heating wire and the fan, respectively.

Further, an AC converter is provided on the main unit, and the AC converter is connected to the control line between the control system and the PTC heating wire.

Further, the main unit is provided with a sewage suction device and a cleaning mechanism, the sewage suction device is connected with the inner bowl through a pipeline, the inner bowl is provided with sprayers, and the cleaning mechanism and the sprayers are connected through a pipeline.

Further, the inner bowl in horn shape is provided in the operating head, a large opening end of the inner bowl is connected to a sheath, the main unit is provided with a negative pressure source and a sewage bucket connected through a pipeline, a small opening end of the inner bowl is provided with a sealing valve, which is connected to the sewage bucket through a water pipe; a clamping slot is provided on a main unit base of the main unit, a deodorizing assembly is provided in the clamping slot, and the deodorizing assembly is connected to an air outlet of the negative pressure source.

Further, the sealing valve comprises a valve seat and a valve cover, the valve cover is provided in the valve seat and is in pin connection therewith, a front end of the valve seat is fit around the small opening end of the inner bowl, so that the valve cover is pressed against the small opening end of the inner bowl, and a rear end of the valve seat is connected to the sewage bucket through a water pipe.

Further, the deodorizing assembly comprises a deodorizing assembly housing and a plurality of filter elements, an inner surface of the deodorizing assembly housing is provided with a connecting opening connected to the air outlet of the negative pressure source, a bottom surface of the deodorizing assembly housing is provided with an air exhaust, a partition passage communicating the connecting opening and the air exhaust is provided in the deodorizing assembly housing, and the plurality of filter elements are arranged sequentially in the partition passage.

Further, a lock cylinder is provided on an outer surface of the deodorizing assembly housing, a spring and a lock catch are fit around the lock cylinder, an upper end of the spring is pressed against the deodorizing assembly housing located at an upper end of the lock cylinder, and the clamping slot of the main unit base is provided with a limit opening cooperating with the lock catch.

Further, a side plate of the housing of the main unit is provided with a detachment opening at a position corresponding to the deodorizing assembly, and a covering plate covers on the detachment opening.

Further, the inner bowl in horn shape is provided in the operating head housing, an upper end of the operating head housing is provided with a sheath connected to a large opening end of the inner bowl; a shunt valve is provided in the operating head housing, a plurality of sprayers are provided at the large opening end of the inner bowl, the plurality of sprayers are connected with the shunt valve through water pipes, a hose is provided between the main unit and a tail end of the operating head housing, a sewage pipe, a clean water pipe and a control line are arranged within the hose, both ends of the sewage pipe are connected respectively to a small opening end of the inner bowl and a sewage suction mechanism on the main unit, both ends of the clean water pipe are connected respectively to the shunt valve and a water supply device on the main unit, and the shunt valve is connected to a control system in the main unit through the control line.

Further, the shunt valve is provided with a plurality of outlet holes, which are connected with the corresponding sprayers one by one through corresponding water pipes.

Further, the water supply device comprises a water tank, a water pump and a PTC heater, the PTC heater is connected to the water tank, the clean water pipe is connected to the water pump, and the water pump is connected to the water tank through a water pipe.

Further, the plurality of sprayers are arranged symmetrically at both sides of the large opening end of the inner bowl, and each sprayer is provided with a flushing nozzle and a cleaning nozzle.

Further, a hose clamp is provided at a connection part of the sewage pipe and the sealing seat.

Further, a tail end of the operating head is provided with a base, both sides of the base are arranged with hook-shaped hangers, and a rear end face of the base is arranged with a polluted water port, a circuit port and a clean water port; a front end of the hose is connected to a plug, both sides of the plug are provided with hasps, and a front end face of the plug is provided with a polluted water joint, a circuit joint and a clean water joint.

Further, the rear end face of the base is provided with a plurality of positioning holes, the plurality of positioning holes are distributed symmetrically along both sides of the center line of the base; the front end face of the plug is provided with a plurality of positioning posts, and the plurality of positioning posts are arranged in pairs with the plurality of positioning holes.

Further, the positioning posts are in frustum structures being small at front end and large at back end, and port edges of the positioning holes are chamfered.

Further, an outer edge of the polluted water port is opened with a first ring groove, an O-shaped sealing ring is arranged around the first ring groove, and an inner diameter of the polluted water joint matches with an outer diameter of the polluted water port.

Further, the rear end face of the base is provided with a fitting hole, the polluted water port is fit into the fitting hole, and an inner diameter of the fitting hole matches with an outer diameter of the polluted water joint.

Further, an outer edge of the clean water joint is provided with a second ring groove, an O-shaped sealing ring is arranged around the second ring groove, and an outer diameter of the clean water joint matches with an inner diameter of the clean water port.

Further, an inner wall of the circuit port is provided with a guide bar, and an outer wall of the circuit joint is opened with a guide groove cooperating with the guide bar.

Further, a main unit housing is comprised, a panel of main unit housing is provided with a connecting base, an outer edge of a front end of the connecting base is provided with screws, both sides of an inner hole in the connecting base is provided with baffles, the connecting base is connected to a nut sleeve, a hose sleeve, a first pipe joint and a second pipe joint; a second casing pipe and a second water pipe are provided on the second pipe joint, front ends of the second casing pipe and the second water pipe pass through the baffles, the second pipe joint is pressed against a rear side of the baffle, a stop collar, a first casing pipe and a first water pipe are provided on the first pipe joint, front ends of the first casing pipe and the first water pipe are arranged in the stop collar, a rear end of the first casing pipe passes through the front end of the second casing pipe, a rear end of the first water pipe passes through the front end of the second water pipe; a rear end of the hose sleeve covers around the stop collar, the nut sleeve covers around the hose sleeve, and a rear end of the nut sleeve is screwed to a front end of the connecting base.

Further, guide teeth are provided on an outer edge of a front end of the stop collar, and limit teeth are provided on an inner wall of the hose sleeve.

Further, a pass line groove is provided on the first pipe joint, and a threading hole is provided in the second pipe joint at a position corresponding to the pass line groove.

Further, a plurality of fixing holes are provided in an inner side of the connecting base at a position corresponding to the second pipe joint.

Further, corrugated teeth are provided on outer edges of inner ends of the first water pipe and the second water pipe.

The present disclosure has the following beneficial effects: the structure of the present disclosure is reasonable, the arc-shaped bottom of the bowl mouth is advantageous for the excreta to slide down by gravity, being convenient for flushing and cleaning, and saving water; infrared radiation and multi-region detection is used, achieving automatic distinguish of feces and urine; and a boss destroys creation of a water film, avoiding false triggering and missing detection.

In the nursing machine using the above inner bowl, the control system on the main unit issue commands to control operation of the PTC heating wire and the fan, improving accuracy of controlling air temperature and air flow by programme; the hot air source is closer to the patient, having better drying effect; the heater is arranged independently and uses AC conversion, ensuring the heating power; and the heater is used separately from the power supply, having higher safety.

The main unit base of the main unit is opened with the clamping slot, after the deodorizing filter elements are pushed into the clamping slot via the detachment opening of the side plate, the spring lock catch is inserted in the limit opening to fix, the connecting opening of the assembly is butt-jointed to the air outlet of the negative pressure source, being easy for installation and quick for removal; and the valve cover arranged at the inner port of the inner bowl covers and blocks the sewage suction passage when the negative pressure source is in standby state, avoiding odor in the sewage bucket from coming out to the indoor via the inner bowl.

A clean water pipe is connected between the main unit and the operating head, decreasing the total length of the pipeline and reducing the risk of leakage; the distance between the shunt valve and the sprayers is shortened, reducing the amount of water remained inside the pipeline, avoiding the accumulated cold water from spraying on the patient's body, and improving the use comfort of the nursing machine; the structure of the shunt valve is flexible in use, increasing the number of sprayers without increasing the connecting pipelines.

Multiple position and match are provided on the base and the plug, achieving precise connection, matched diameters and sealing rings are used to seal between the polluted water port and the polluted water joint and between the clean water port and the clean water joint; when the operating head is not in use, fast assembly and flexible disassembly can be achieved through cooperation between the base and the plug and connection between the hasps and the hangers, with stable connection and convenient use.

By means of cooperation and connection of the nut sleeve, the first pipe joint, the second pipe joint and the hose sleeve, the sewage suction pipe, the water pipe and the control line of the nursing machine are integrated and then coated and connected by an insulating hose, avoiding water from leakage; and it is quick and easy by using threaded connection and cooperation, ensuring the hose not falling off freely from the main unit.

Figure 1:
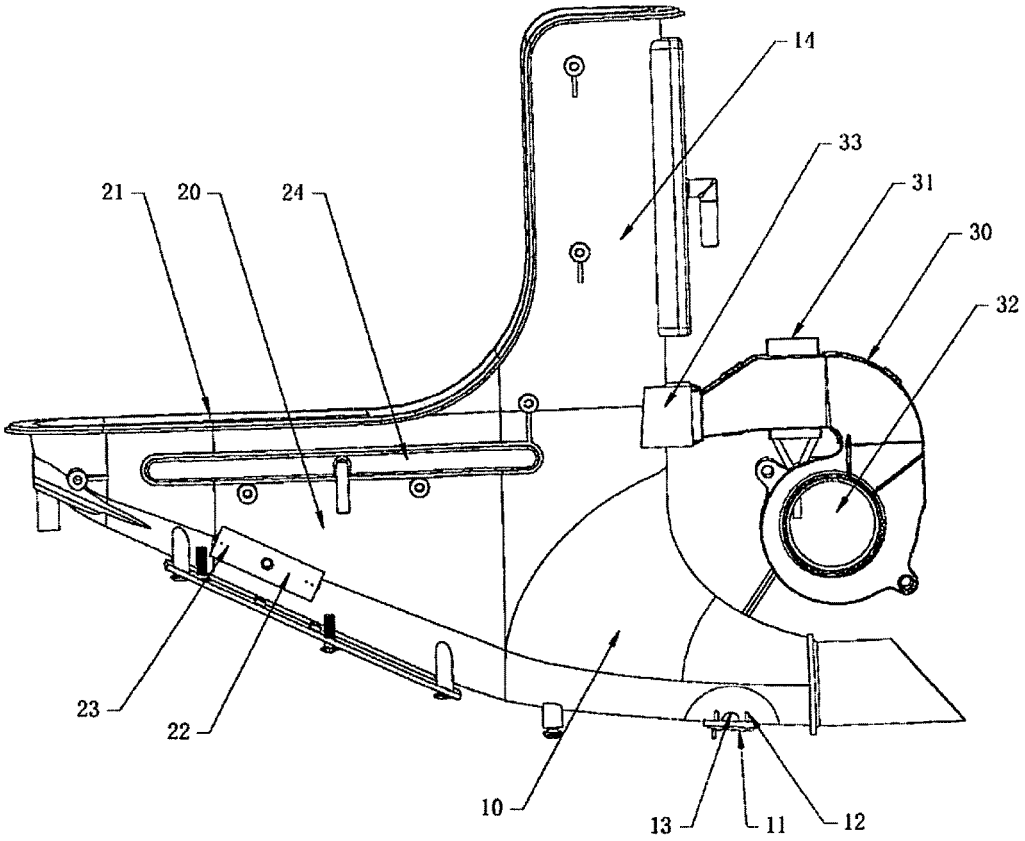
FIG. 1 is a front structural schematic diagram showing the overall of an inner bowl of an operating head of a nursing machine of the present disclosure.
Figure 2:
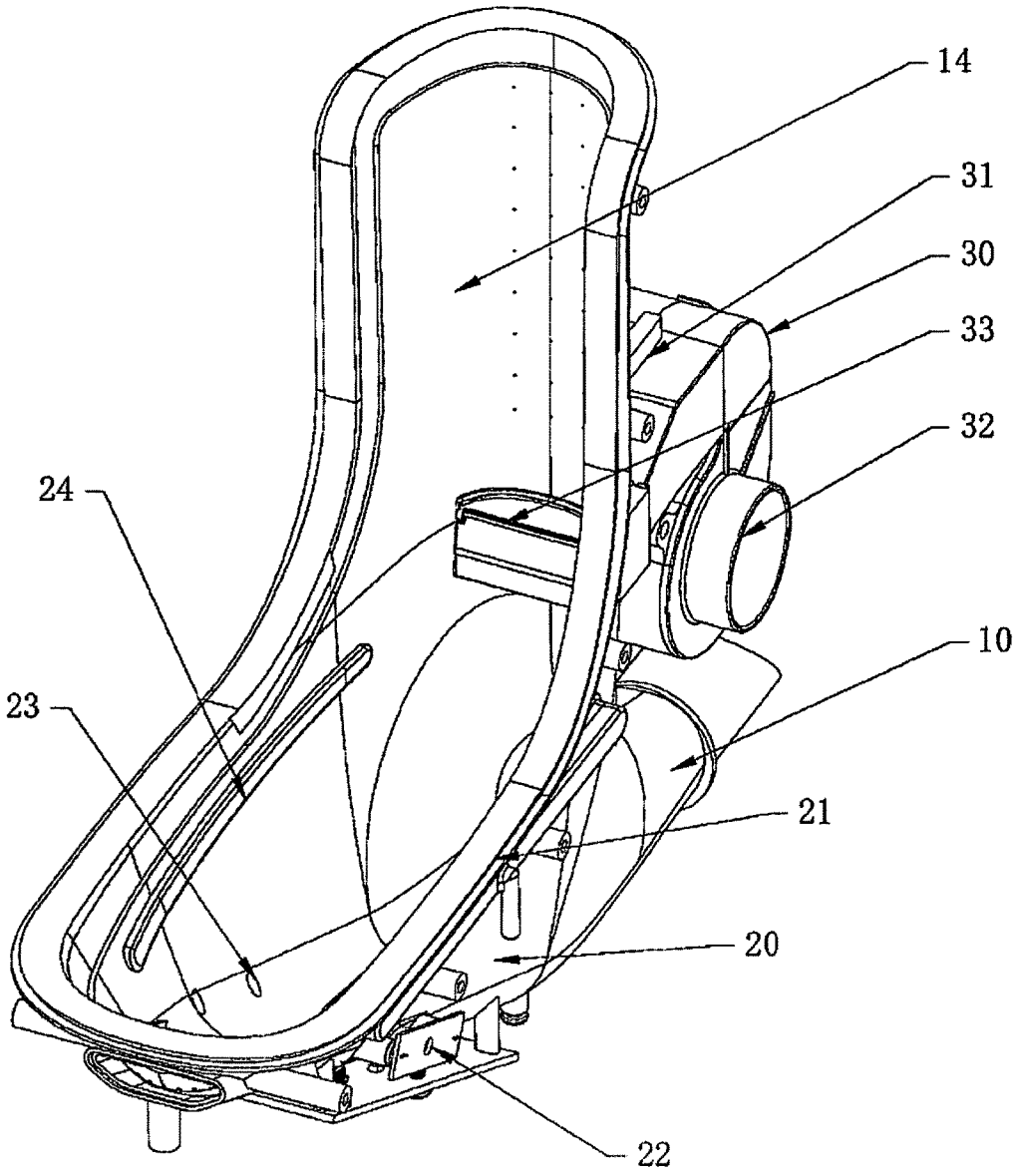
FIG. 2 is a perspective structural schematic diagram showing the overall of the inner bowl of the operating head of the nursing machine of the present disclosure.
Figure 3:
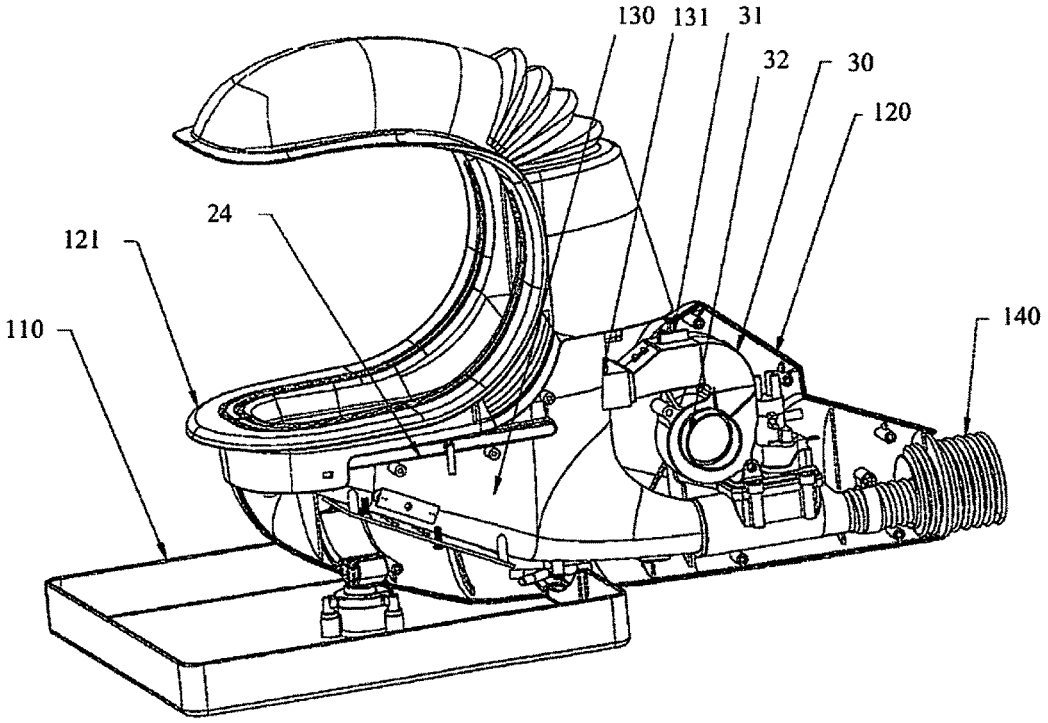
FIG. 3 is a first structural schematic diagram showing the part of the operating head of the nursing machine of the present disclosure.
Figure 4:
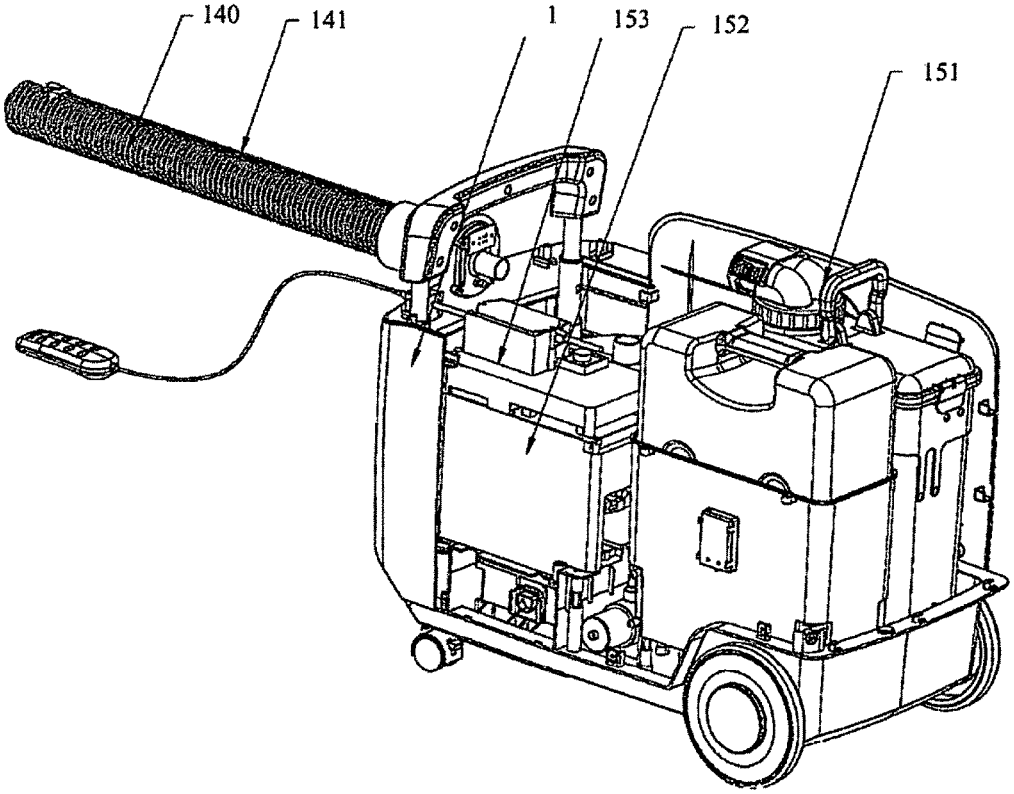
FIG. 4 is a first structural schematic diagram showing the part of the main unit of the nursing machine of the present disclosure.
Figure 5:
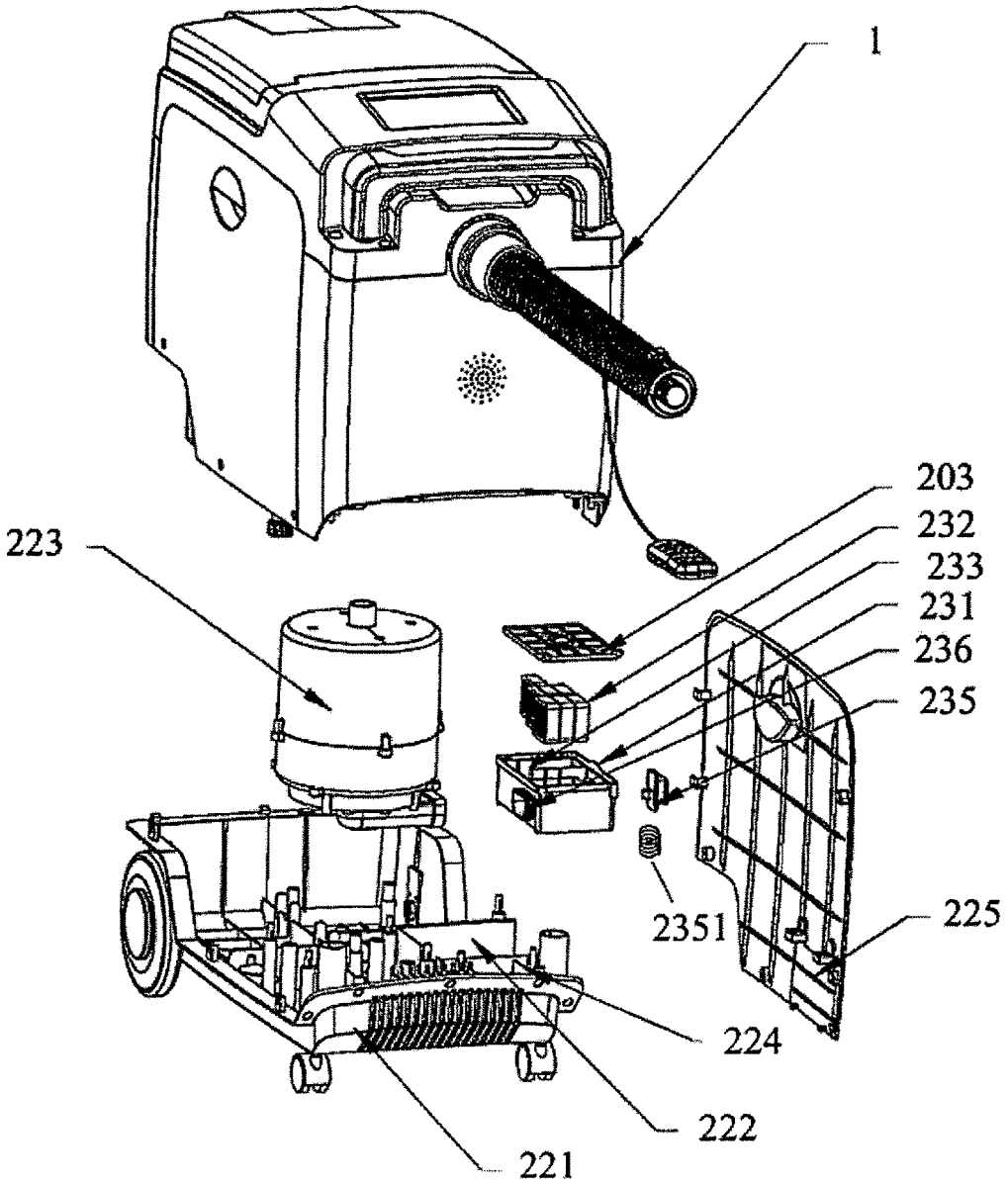
FIG. 5 is an exploded structural schematic diagram showing the part of the main unit of the nursing machine of the present disclosure.
Figure 6:
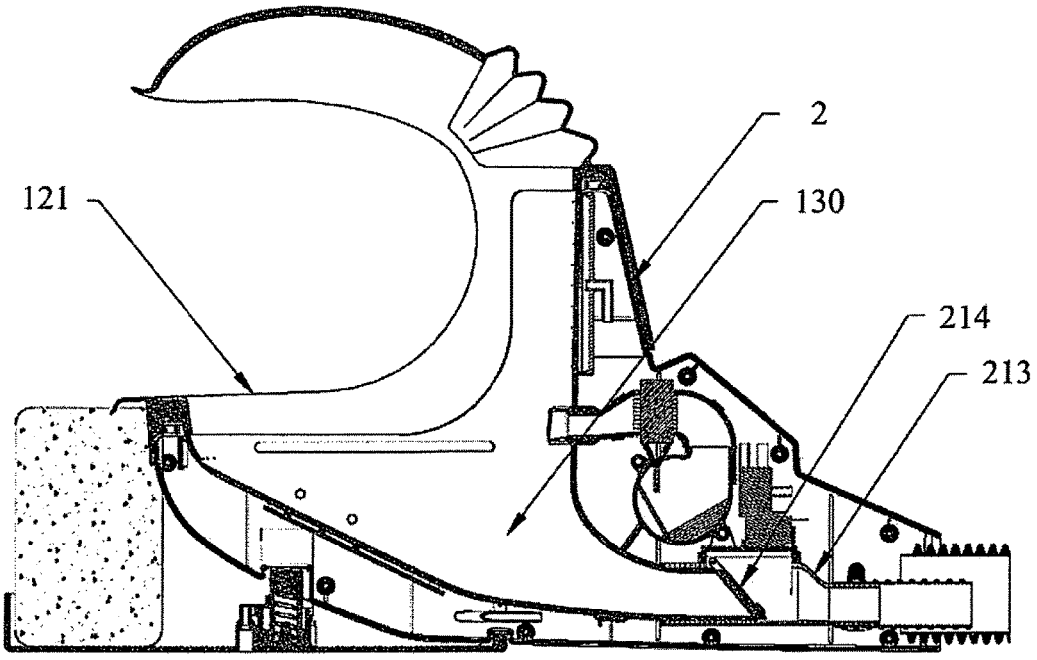
FIG. 6 is a sectional structural schematic diagram showing the part of the operating head of the nursing machine of the present disclosure.
Figure 7:
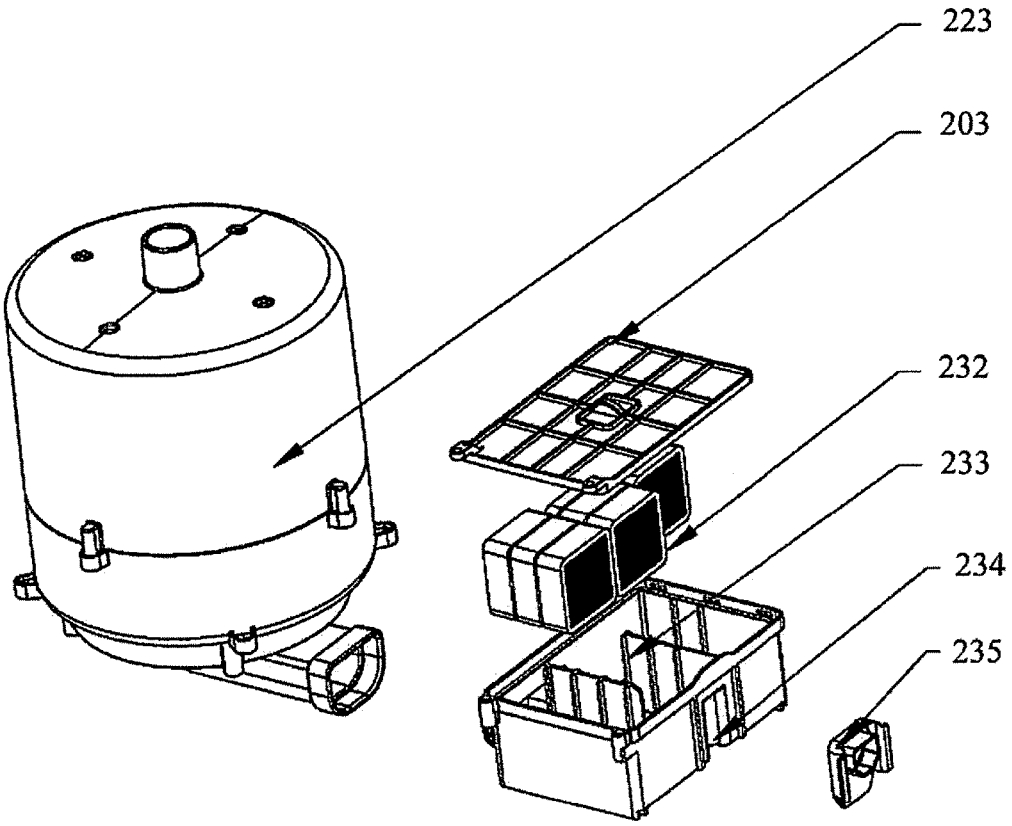
FIG. 7 is an exploded structural schematic diagram showing the part of a deodorizing assembly of the nursing machine of the present disclosure.
Figure 8:
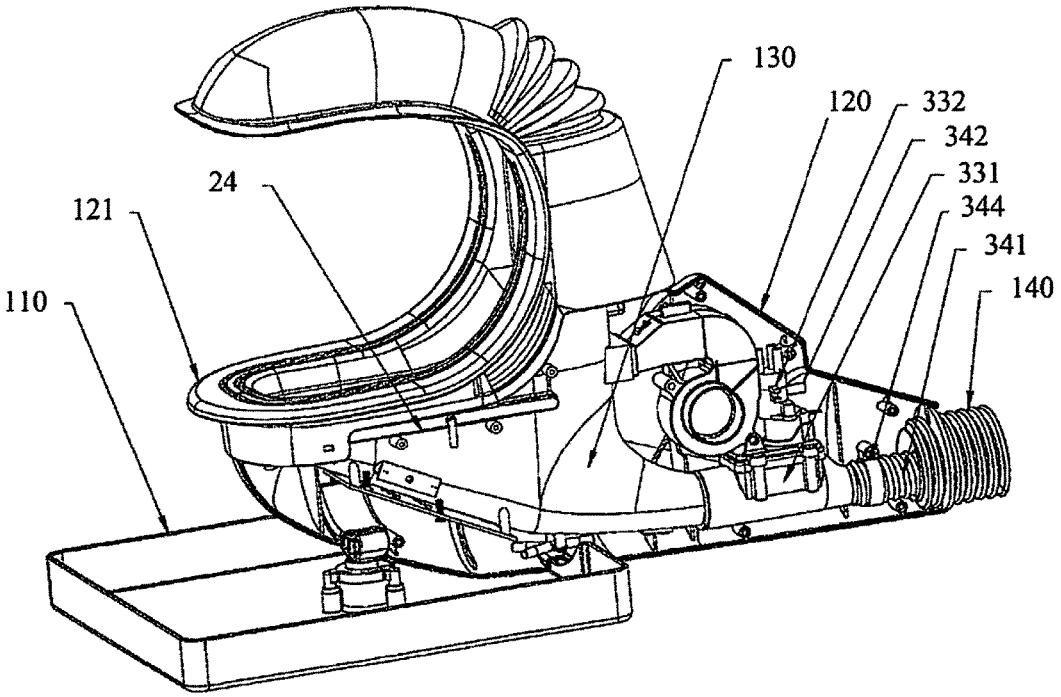
FIG. 8 is a second structural schematic diagram showing the part of the operating head of the nursing machine of the present disclosure.
Figure 9:
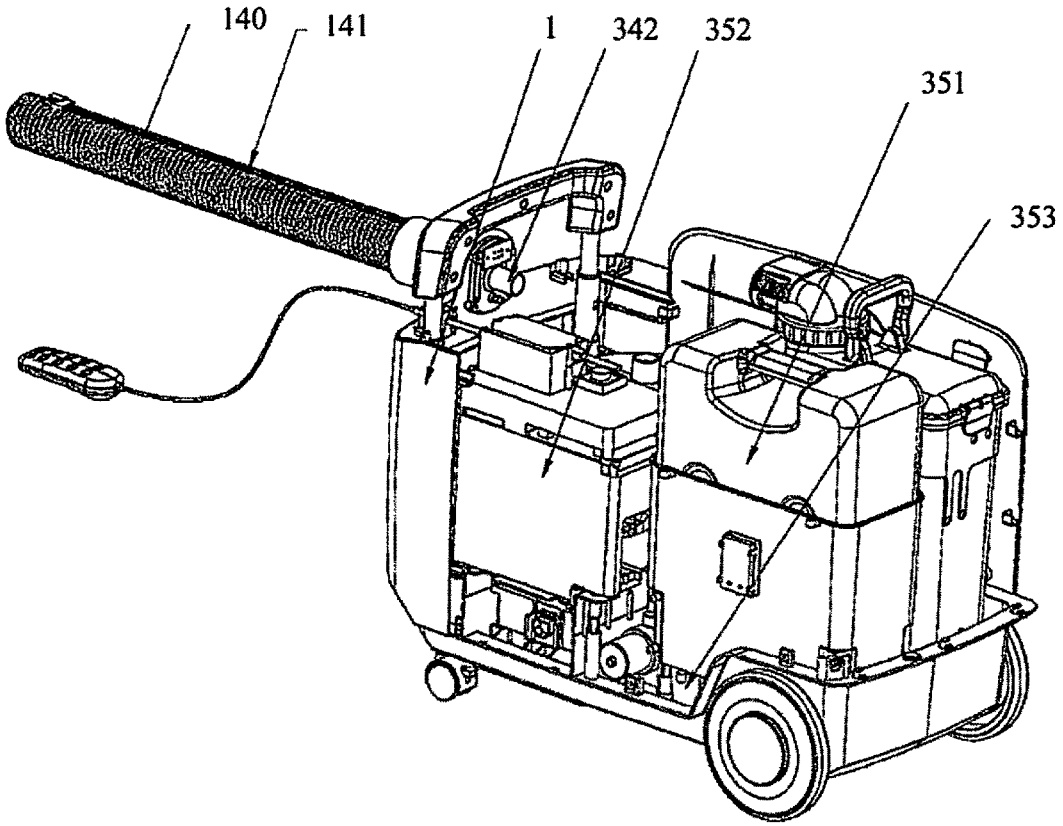
FIG. 9 is a second structural schematic diagram showing the part of the main unit of the nursing machine of the present disclosure.
Figure 10:
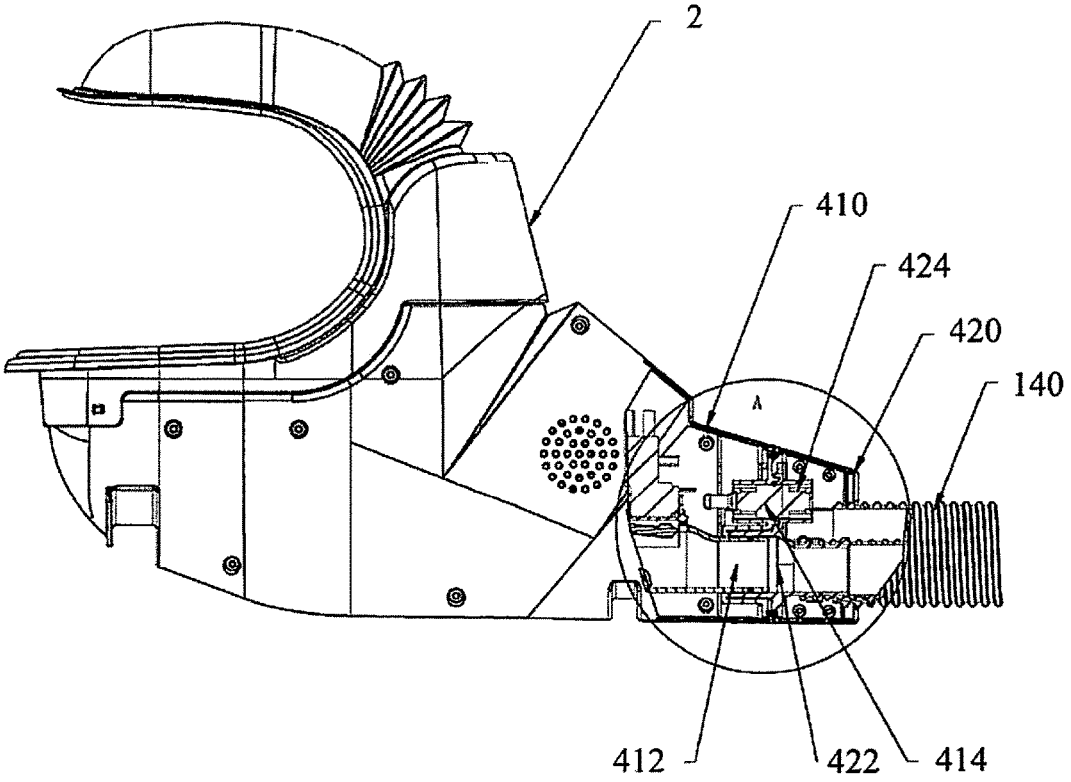
FIG. 10 is a sectional structural schematic diagram showing the overall of the nursing machine of the present disclosure.
Figure 11:
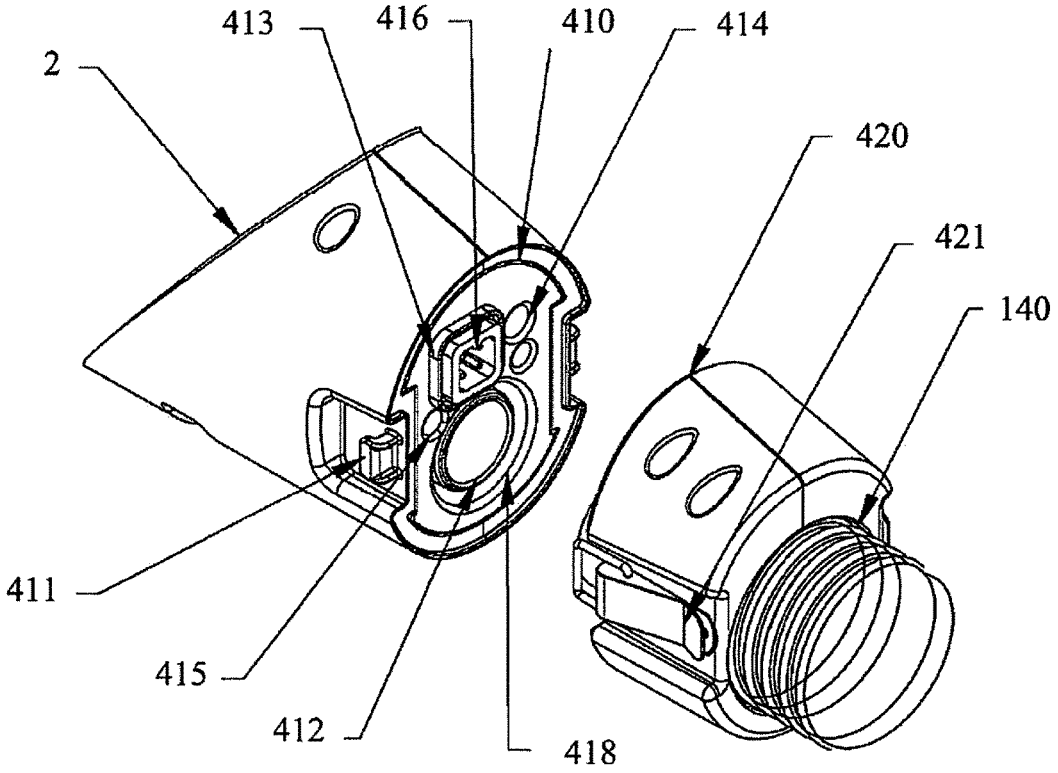
FIG. 11 is an oblique structural schematic diagram showing partial split of the nursing machine of the present disclosure.
Figure 12:
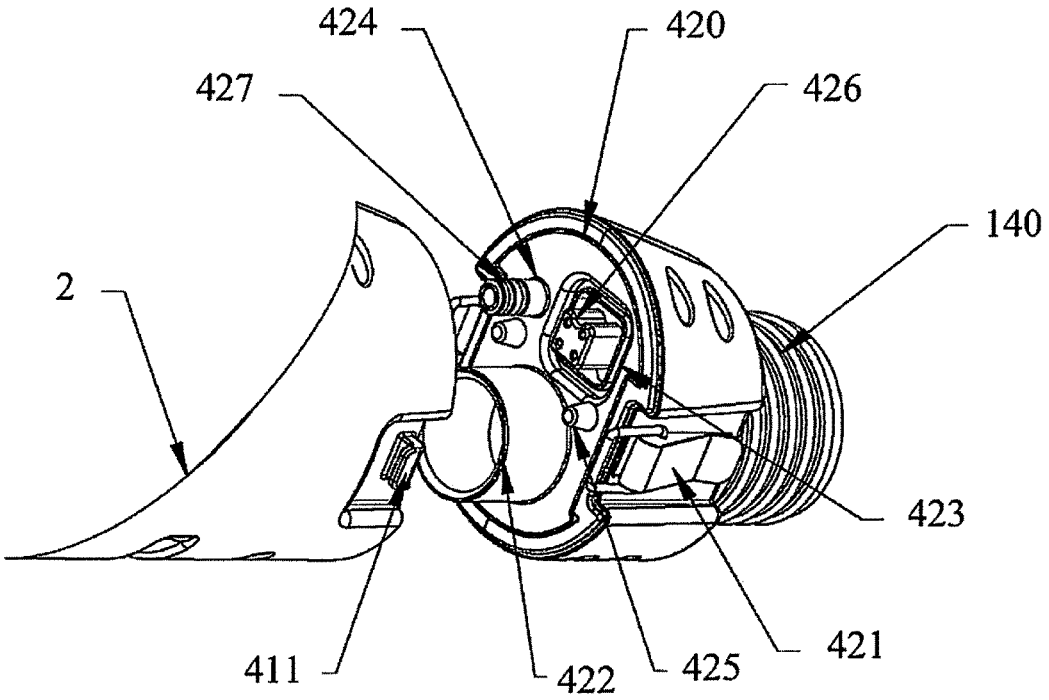
FIG. 12 is another oblique structural schematic diagram showing partial split of the nursing machine of the present disclosure.
Figure 13:
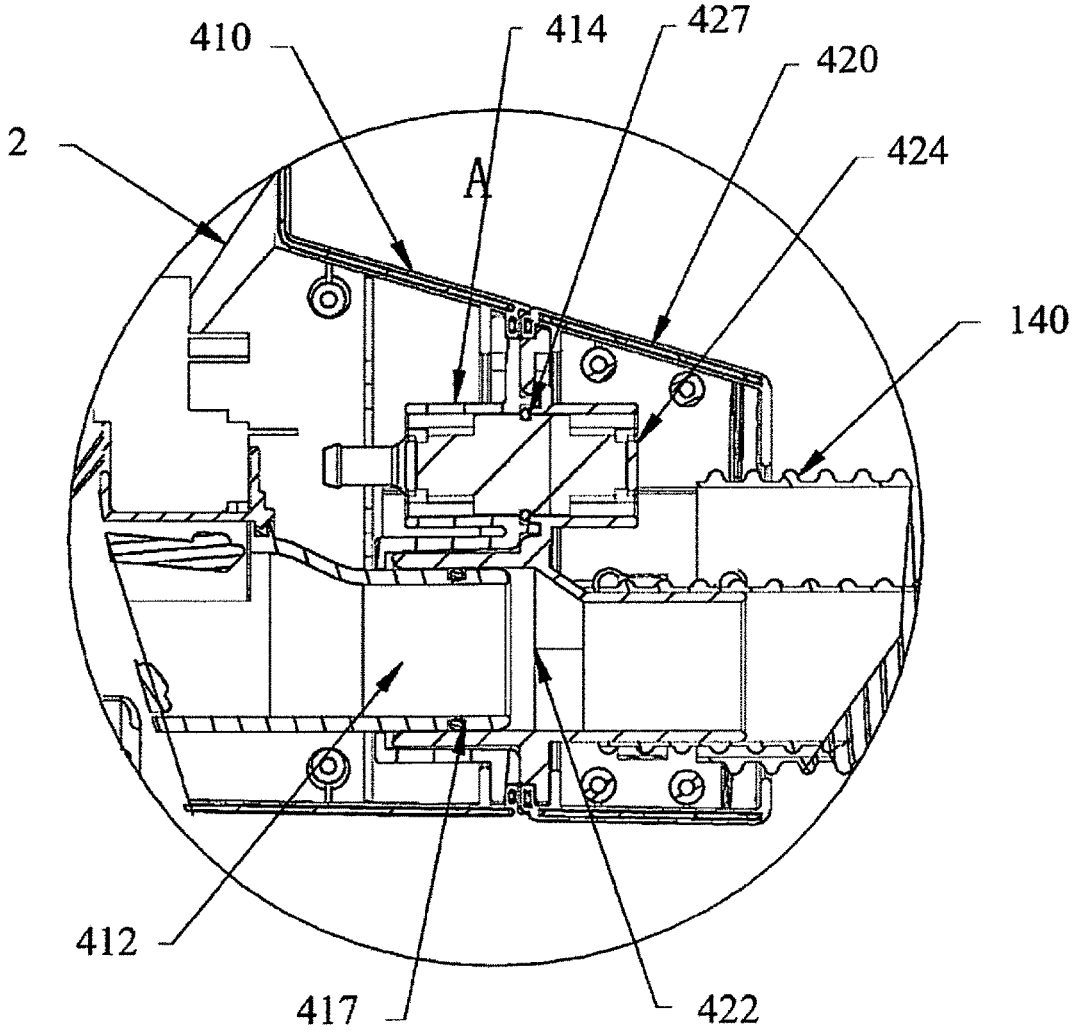
FIG. 13 is an enlarged structural schematic diagram showing partial section of the nursing machine of the present disclosure.
Figure 14:
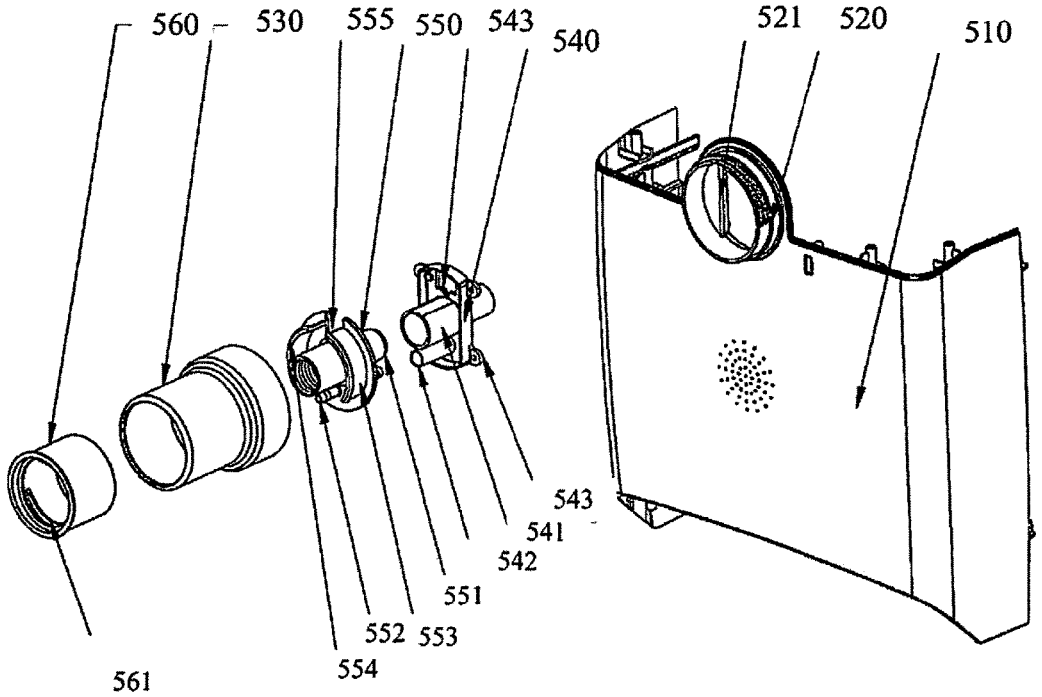
FIG. 14 is a structural schematic diagram showing the overall of the nursing machine of the present disclosure.
Figure 15:
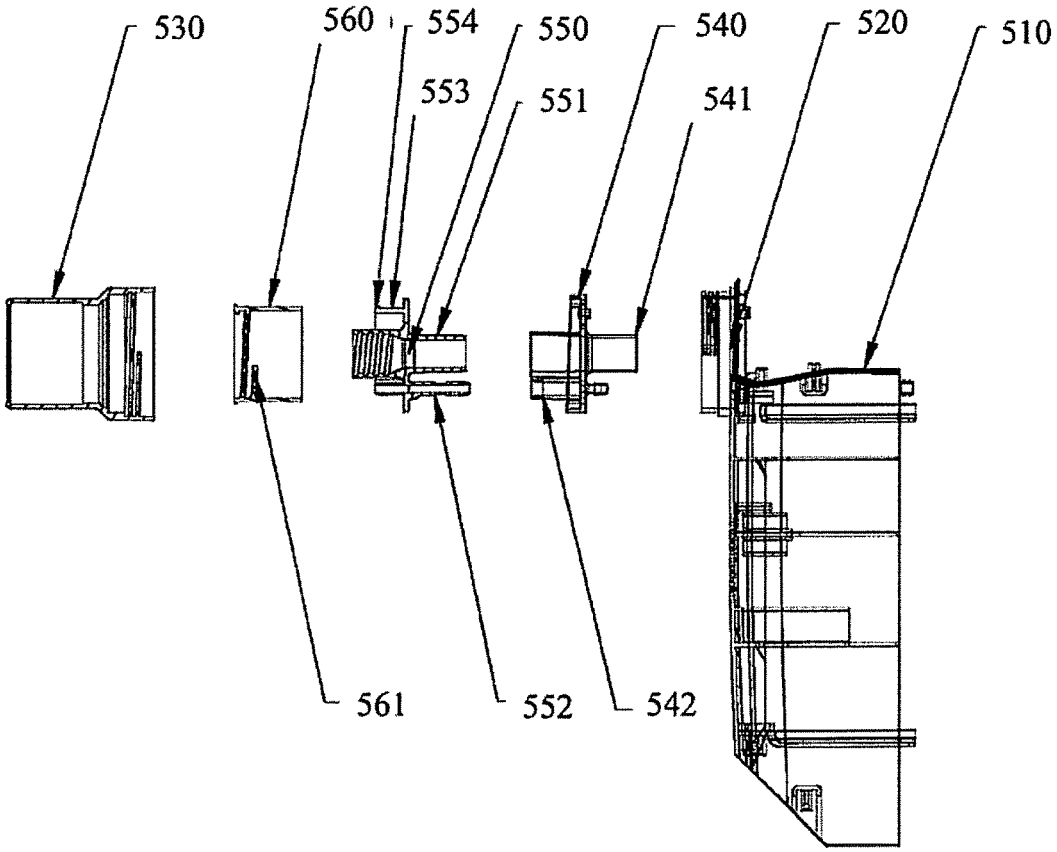
FIG. 15 is a sectional structural schematic diagram showing the nursing machine of the present disclosure.

1: main unit; 2: operating head;

10: bowl body; 11: urine sensor; 12: metal probe; 13: boss; 14: baffle;

20: bowl mouth; 21: drain port; 22: feces sensor; 23: sensing probe; 24: sprayer;

30: drying device housing; 31: PTC heating wire; 32: fan; 33: air outlet;

110: seat; 120: operating head housing; 121: sheath; 130: inner bowl; 131: air outlet;

140: hose; 141: control line; 151: sewage suction device; 152: cleaning mechanism;

153: AC converter; converter; 203: deodorizing assembly; 213: valve seat; 214: valve cover;

221: main unit base; 222: clamping slot; 223: negative pressure source;

224: limit opening; 225: covering plate; 231: deodorizing assembly housing; 232: filter element;

233: partition passage; 234: lock cylinder; 235: lock catch; 236: connecting opening;

331: sealing seat; 332: shunt valve; 341: sewage pipe; 342: clean water pipe;

344: hose clamp; 351: water tank; 352: water pump; 353: heater;

410: base; 411: hanger; 412: polluted water port; 413: circuit port; 414: clean water port;

415: positioning hole; 416: guide bar; 417: first ring groove; 418: fitting hole;

420: plug; 421: hasp; 422: polluted water joint; 423: circuit joint;

424: clean water joint; 425: positioning post; 426: guide groove; 427: second ring groove;

510: main unit housing; 520: connecting base; 521: baffle; 530: nut sleeve;

540: second pipe joint; 541: second casing pipe; 542: second water pipe; 543: threading hole;

550: first pipe joint; 551: first casing pipe; 552: first water pipe; 553: stop collar;

554: guide tooth; 555: pass line groove; 560: hose sleeve; 561: limit tooth.

DETAILED DESCRIPTION

The present disclosure is further described below in combination with accompanying drawings.

An inner bowl of an operating head of a nursing machine of the present disclosure comprises a bowl body 10, a baffle 14 and a drying device. A wedge-shaped bowl mouth 20 is provided at the front portion of the bowl body 10, the top surface of the bowl mouth 20 is a horizontally arranged drain port 21, and the bottom surface of the bowl mouth 20 is an obliquely arranged U-shaped arc bottom, and excreta falls freely via the oblique arc bottom of the bowl mouth 20 to make more efficient flushing and cleaning, saving water. Both sides of the U-shaped arc bottom of the bowl mouth 20 are provided with reflective infrared feces sensors 22, which cover a part of the arc bottom of the bowl mouth 20 to avoid missing detection. The outer bottom surface of the bowl body 10 is provided with a urine sensor 11, which cooperates with the feces sensors 22 to achieve distinguish detection, avoiding false triggering operation. The baffle 14 is vertically arranged on the bowl body 10 and connected to the drain port 21, being integrally disposed. The drying device is provided at the rear side of the bowl body 10, and an air outlet 33 of the drying device is located on the rear sidewall of the bowl body 10 below the baffle 14.

A plurality of sensing probes 23 are provided for the feces sensors 22, the plurality of sensing probes are arranged from front to back along the sides of the bowl mouth 20 and correspond to different bottom regions of the bowl mouth 20, and the plurality of sensing probes 23 cover part of the bottom regions of the bowl mouth 20, avoiding missing detection caused by drifting of the excreta. Two metal probes 12 are provided for the urine sensor 11, the two metal probes 12 penetrate and protrude from the bottom surface of the bowl body 10, a boss 13 is provided in the bottom surface of the bowl body 10 between the two metal probes 12, and the boss 13 is used for destroying creation of a water film between the two metal probes 12, avoiding missing detection caused by signal shielding from the water film to the urine sensor 11.

A left and a right sprayers 24 are provided at both sides of the bowl mouth 20, the sprayers 24 are disposed horizontally below the drain port 21 and provided with a plurality of openings for flushing the side walls and the bottom surface of the bowl mouth 20, improving cleaning efficiency.

The drying device comprises a drying device housing 30, a fan 32 and a PTC heating wire 31, an air outlet 33 at the front end of the drying device housing 30 is connected to the rear sidewall of the bowl body (10), the PTC heating wire 31 is provided in the front portion of the drying device housing 30, and the fan 32 is provided in the tail portion of the drying device housing 30.

A nursing machine adopting the above inner bowl comprises a main unit 1 and an operating head 2, which comprising a seat 110 and an operating head housing 120, the operating head housing 120 is flexibly provided on the seat 110, a horn-shaped inner bowl 130 is provided in the operating head housing 120, an upper end of the operating head housing 120 is provided with a sheath 121 connected to a large opening end of the inner bowl 130, the sheath 121 is in a U-shaped opening arrangement and touches with the patient's body, and the inner bowl 130 is placed beneath the patient's body for receiving excreta; a drying device is provided in the operating head housing 120, an air outlet 131 of the drying device is connected with the inner bowl 130. After the patient's body is cleaned by the operating head, warm air is output from the drying device, the air outlet 131 directly facing lower body of the patient outputs the warm air to dry moisture, since the drying device is provided at the operating head, the drying efficiency is improved by blowing in a short distance. The main unit 1 is provided with a control system, which is electrically connected with the drying device, the control system can adjust the PTC heating wire 31 and the fan 32 of the drying device, respectively, according to set programs, improving drying effect while saving energy.

The drying device comprises a volute-shape drying device housing 30, a PTC heating wire 31 and a fan 32, the front end of the drying device housing 30 is connected to the air outlet 131, the PTC heating wire 31 is provided in the drying device housing 30, and the fan 32 is provided in the tail portion of the drying device housing 30. Cold air generated by the fan 32 blows to the air outlet 131 through the drying device housing 30, heat transfer is carried out by convection when the air passes through the FTC heating wire 31, and the heated air discharges in a short distance, reducing heat loss and increasing drying efficiency. The PTC heating wire 31 and the fan 32 are separately electrically connected with the control system, achieving precise energy save control by programming of the control system.

A hose 140 is provided between the operating head housing 120 and the main unit 1, a control line 141 connected to the control system is provided in the hose 140, the control line 141 is connected to the PTC heating wire 31 and the fan 32, respectively, the control line 141 makes the PTC heating wire 31 and the fan 32 are spaced apart from a power of the main unit 1, and power-off protection is achieved by the control system, improving safety of use.

The main unit 1 is provided with an AC converter 153, which is connected to the control line 141 between the control system and the PTC heating wire 31, and the AC converter 153 converts direct current supplied by the power, so that the PTC heating wire 31 can generate higher heating power, increasing the drying speed.

The main unit 1 is provided with a sewage suction device 151 and a cleaning mechanism 152, the sewage suction device 151 is connected with the inner bowl 130 through a pipeline, and then the patient's excreta is sucked and collected in a sewage case, the inner bowl 130 is provided with sprayers 24, the cleaning mechanism 152 and the sprayers 24 are connected through a pipeline, a water pump on the cleaning mechanism 152 provides clean water to the sprayers 24 to wash the inner bowl 130 and clean the patient's body.

The inner bowl 130 in horn shape is provided in the operating head 2, a large opening end of the inner bowl 130 is connected to a sheath 121, the main unit 1 is provided with a negative pressure source 223 and a sewage bucket connected through a pipeline, when the negative pressure source 223 is turned on, negative pressure is generated in the sewage bucket to ventilate, and then the excreta in the inner bowl 130 connected through the pipe is sucked into the sewage bucket. The small opening end of the inner bowl 130 is provided with a sealing valve, which is connected to the sewage bucket through a water pipe, the sealing valve opens a connection pipeline when the negative pressure source 223 is turned on, and closes it when the negative pressure source is turned off, so that the pipe passage between the sewage bucket and the operating head 2 is shut off, avoiding odor from coming out. A clamping slot 222 for connecting and mounting a deodorizing assembly 203 is provided on a main unit base 221 of the main unit 1, the deodorizing assembly 203 is provided in the clamping slot 222, the deodorizing assembly 203 is connected to an air outlet of the negative pressure source 223, the air with odor in the sewage bucket is filtered by the deodorizing assembly 203 when the negative pressure source 223 extracting it, and then the odor caused by operation of the negative pressure source 223 is removed, avoid emitting to the indoor.

The sealing valve comprises a valve seat 213 and a valve cover 214, which is provided in the valve seat 213 and is in pin connection therewith, the valve cover 214 and valve seat 213 are hinged, and then when the negative pressure source 223 works, water and excreta in the inner bowl 130 is flushed into the pipeline, and the valve cover 214 flips automatically to open the passage of the sealing valve. The front end of the valve seat 213 is fit around the small opening end of the inner bowl 130, so that the valve cover 214 is pressed against the small opening end of the inner bowl 130, the valve cover 214, due to its gravity, covers the end of the inner bowl 130 when the main unit 1 is in standby state, avoiding the odor coming out from the pipeline to the operating head 2, and the rear end of the valve seat 213 is connected to the sewage bucket through a water pipe.

The deodorizing assembly 203 comprises a deodorizing assembly housing 231 and a plurality of filter elements 232. The inner surface of the deodorizing assembly housing 231 is provided with a connecting opening 236 connected to the air outlet of the negative pressure source 223, a sealing ring is provided on the connecting opening 236 to strength connection and cooperation with the air outlet of the negative pressure source 223, the bottom surface of the deodorizing assembly housing 231 is provided with an air exhaust, a partition passage 233 communicating the connecting opening 236 and the air exhaust is provided in the deodorizing assembly housing 231, and the plurality of filter elements 232 are arranged sequentially in the partition passage 233. The air with odor extracted by the negative pressure source 223 enters the deodorizing assembly housing 231 from the connecting opening 236, and discharges out of the air exhaust after being filtered by the filter elements 232 arranged in the partition passage 233, avoid the odor emitting to the indoor. The partition passage 233 can increase the path that the air passes through the deodorizing assembly housing 231, improving filtering effect of the filter elements 232.

The outer surface of the deodorizing assembly housing 231 is provided with a lock cylinder 234, around which a spring 2351 and a lock catch 235 are arranged, the upper end of the spring 2351 is pressed against the deodorizing assembly housing 231 located at the upper end of the lock cylinder 234, and the clamping slot 222 of the main unit base 221 is provided with a limit opening 224 cooperating with the lock catch 235. After the deodorizing assembly 203 is inserted into the clamping slot 222 matching therewith, the lock catch 235 is driven by the spring 2351 and slides downward to snap into the limit opening 224, and the connecting opening in the inner surface of the deodorizing assembly housing 231 is butt-jointed and fixed to the air outlet of the negative pressure source 223, making the deodorizing assembly 203 horizontally fixed to the main unit base 221. The lock catch 235 is pulled up to remove the deodorizing assembly 203 when disassembling.

A side plate of the housing of the main unit 1 is provided with a detachment opening at a position corresponding to the deodorizing assembly 203, a covering plate 225 covers on the detachment opening, and the detachment opening matches with the deodorizing assembly 203 to facilitate assembly and disassembly.

Front end of the operating head housing 120 is flexibly provided on the seat 110, the inner bowl 130 in horn shape is provided in the operating head housing 120, an upper end of the operating head housing 120 is provided with a sheath 121 connected to a large opening end of the inner bowl 130, the sheath 121 is in a U-shaped opening shape, and the bottom of the sheath 121 is opened with an opening and connected to the large opening end of the inner bowl 130. The small opening end of the inner bowl 130 is provided with a sealing seat 331, which is connected with the inner bowl 130 through screws and a sealing ring is provided at the connection, a shunt valve 332 is provided in the operating head housing 120, the shunt valve 332 is connected to the sealing seat 331 and provided with a plurality of outlet holes, a plurality of sprayers 24 are provided at the large opening end of the inner bowl 130 are connected with the plurality of outlet holes in the shunt valve 332 through water pipes. Clean water is guided to the corresponding sprayers 24 from the shunt valve 332, and the shunt valve 332 is controlled by the control system in the main unit 1 to supply water to the corresponding sprayers 24, and then to clean the patient or to flush the inner bowl 130 in the operating head. A hose 140 is provided between the main unit 1 and the tail end of the operating head housing 120, a sewage pipe 341, a clean water pipe 342 and a control line 141 are arranged within the hose 140, both ends of the sewage pipe 341 are connected to the sealing seat 331 and a sewage suction mechanism on the main unit 1, respectively, both ends of the clean water pipe 342 are connected to the shunt valve 332 and a water supply device on the main unit 1, respectively, only one clean water pipe 342 is used as the main water supply pipeline, which can shorten the length of the overall pipeline and avoid risk of water leakage. The shunt valve 332 is connected to the control system in the main unit 1 through the control line 141.

The shunt valve 332 is provided with a plurality of outlet holes, which are connected with the corresponding sprayers 24 one by one through corresponding water pipes, and the main unit 1 controls the corresponding sprayers 24 via the shunt valve 332 for cleaning work.

The water supply device comprises a water tank 351, a water pump 352 and a PTC heater 353, the PTC heater 353 is connected to the water tank 351, the clean water pipe 342 is connected to the water pump 352, and the water pump 352 is connected to the water tank 351 through a water pipe. The water pump 352 extracts the heated water from the water tank 351, the water is supplied from the clean water pipe 342 to the shunt valve 332, the sprayer for flushing 24 is firstly turned on to use residual cold water in the clean water pipe 342, after completion, hot water is in the clean water pipe 342, and then the sprayer for cleaning 24 is turned on to clean the patient, improving use comfort of the nursing machine.

The plurality of sprayers 24 are arranged symmetrically at both sides of the large opening end of the inner bowl 130, and each sprayer 24 is provided with a flushing nozzle and a cleaning nozzle.

A hose clamp 344 is provided at the connection part of the sewage pipe 341 and the sealing seat 331, the sealing seat 331 is made of copper material, the connection strength can be increased by hose clamp 344, avoid polluted water pollution from pulling away due to pressing and dragging.

The operating head 2 is provided with an excrement container, a water spray mechanism and a control processor, the tail end of the operating head 2 is provided with a base 410, both sides of which are arranged with hook-shaped hangers 411, and the rear end face of which is arranged with a polluted water port 412, a circuit port 413 and a clean water port 414, the polluted water port 412 is connected to the drain port of the excrement container on the operating head 2, the circuit port 413 is connected to the control processor, and the clean water port 414 is connected to the water spray mechanism. The front end of the hose 140 is connected to a plug 420, the front end face of which of which matches with the rear end face of the base 410, and both sides of which are provided with hasps 421, each hasp includes a pinch plate and a retaining ring, one end of the pinch plate is hinged to the plug 420, the rear end of the retaining ring is flexibly connected to the pinch plate, after the front ends of the retaining rings are hooked on the hangers 411, and the pinch plates flip backwards, making the plug 420 and the base 410 connected tightly. The front end face of the plug 420 is provided with a polluted water joint 422, a circuit joint 423 and a clean water joint 424, the polluted water joint 422 is connected with a polluted water pipe in the hose 140, the circuit joint 423 is connected with a circuit line in the hose 140, and the clean water joint 424 is connected with a clean water pipe in the hose 140. By virtue of the detachable connection structure between the base 410 and the plug 420, the operating head 201 can be stored after disassembling with the hose 140 when in idle, and the hose 140 can be arranged spirally on the main unit of the nursing machine.

The rear end face of the base 410 is provided with a plurality of positioning holes 415, which are distributed symmetrically along both sides of the center line of the base 410; the front end face of the plug 420 is provided with a plurality of positioning posts 425, which are arranged in pairs with the plurality of positioning holes 415, the plug 420 is connected to the base 410 by alignment and cooperation of the positioning posts 425 and the positioning holes 415, improving accuracy of assembly and speed of connection, and the connection strength between the base and the plug 420 can be increased due to cooperative relationship after the positioning posts 425 being inserted into the positioning holes 415.

The positioning posts 425 are in frustum structures being small at front end and large at back end, port edges of the positioning holes 415 are chamfered, and the positioning posts 425 in frustum structures have roles of adaptation and adjustment during assembly, thereby enabling the positioning posts 425 easily insert into the positioning holes 415 to improve precision and speed of assembly.

The outer edge of the polluted water port 412 is opened with a first ring groove 417, around which is arranged an O-shaped sealing ring, the inner diameter of the polluted water joint 422 matches with the outer diameter of the polluted water port 412, the diameter of the outer edge of the 412 O-shaped sealing ring is greater than that of the polluted water port 412. When the polluted water joint 422 is arranged into the polluted water port 412, the O-shaped sealing ring deforms and presses against the inner wall of the polluted water joint 422, thereby improving the seal of connection between the polluted water joint 422 and the polluted water port 412.

The rear end face of the base 410 is provided with a fitting hole 418, into which the polluted water port 412 is fit, the inner diameter of the fitting hole 418 matches with the outer diameter of the polluted water joint 422, and the polluted water joint 422 is inserted between the polluted water port 412 and the fitting hole 418, improving assembly precision and connection strength of the polluted water joint 422 and the polluted water port 412.

The outer edge of the clean water joint 424 is provided with a second ring groove 427, around which is arranged an O-shaped sealing ring, the outer diameter of the clean water joint 424 matches with the inner diameter of the clean water port 414, and the tightness of connection between the clean water joint 424 and the clean water port 414 is improved through the O-shaped sealing ring.

The inner wall of the circuit port 413 is provided with a guide bar 416, and the outer wall of the circuit joint 423 is opened with a guide groove 426 cooperating with the guide bar 416, when the circuit joint 423 and the circuit port 413 are assembled, the assembly precision can be improved through the guiding role of the guide groove 426 and the guide bar.

The main unit comprises a main unit housing 520, a panel of main unit housing 520 is provided with a connecting base 520, into which is opened with an inner through hole communicating both sides of it, the outer edge of the front end of the connecting base 520 is provided with screws, both sides of the through hole in the connecting base 520 is provided with baffles 521, which are arranged symmetrically and spaced apart. The connecting base 520 is connected to a nut sleeve 530, a hose sleeve 560, a first pipe joint 550 and a second pipe joint 540. A second casing pipe 541 and a second water pipe 542 are provided on the second pipe joint 540, the front ends of the second casing pipe 541 and the second water pipe 542 pass through the baffles 521, the second pipe joint 540 is pressed against the rear side of the baffle 521, the second pipe joint 540 is arranged at the rear side of the panel and fixedly connected to the connecting base 520, and the rear end of the second water pipe 542 is connected to the water supply system within the main unit via a pipeline. A stop collar 553, a first casing pipe 551 and a first water pipe 552 are provided on the first pipe joint 550, the front ends of the first casing pipe 551 and the first water pipe 552 are arranged in the stop collar 553, the rear end of the first casing pipe 551 passes through the front end of the second casing pipe 541, the rear end of the first water pipe 552 passes through the front end of the second water pipe 542, the stop collar 553 is used for connecting and fixing an insulating hose, the polluted water pipe passes through the first casing pipe 551, and the rear end of the first water pipe 552 is provided with a sealing ring and then forms a passage by cooperation and connection with the second water pipe 542. The rear end of the hose sleeve 560 covers around the stop collar 553, after the insulating hose passes through the hose sleeve 560, the latter covers around and fixes on the stop collar 553, the nut sleeve 530 covers around the hose sleeve 560, and the rear end of the nut sleeve 530 is screwed to the front end of the connecting base 520.

Guide teeth 554 are provided on the outer edge of the front end of the stop collar 553, limit teeth 561 are provided on the inner wall of the hose sleeve 560, and the insulating hose is a threaded pipe and forms a threaded connection and cooperation with the guide teeth 554 and the limit teeth 561, avoiding the hose from falling off freely from the main unit.

A pass line groove 555 is provided on the first pipe joint 550, a threading hole 543 is provided in the second pipe joint 540 at a position corresponding to the pass line groove 555, the control line can also be arranged in the insulating hose, and the control line is connected to the control system in the main unit after passing through the hose sleeve 560, the pass line groove 555 and the threading hole 543.

A plurality of fixing holes 543 are formed inside the connecting base 520 and at corresponding positions of the second pipe joint 540, the rear side of the connecting base 520 is provided with a limit groove, and the second pipe joint 540 is fixedly connected to the connecting base 520 after being snapped into the limit groove by screws inserting the fixing holes 543.

Corrugated teeth are provided on the outer edges of the inner ends of the first water pipe 552 and the second water pipe 542, the pipeline fits over the corrugated teeth with a greater amount of interference, and the corrugated teeth are in sharp shape, thereby improving the tightness of connection between the first water pipe 552, the second water pipe 542 and the pipeline, and avoiding water leakage.

The above only describes preferred embodiments of the present disclosure, and therefore any equivalent variations or modifications made according to configurations, features and principles under the scope of the present patent application, are included within the scope of the present disclosure.

What is claimed is:

1. A nursing machine comprising a main unit and an operating head, wherein the operating head comprises an inner bowl;

wherein the inner bowl comprises a bowl body and a drying device, a bowl mouth is provided at a front portion of the bowl body;

wherein an air outlet of the drying device is connected with the inner bowl, and the main unit is provided with a control system which is electrically connected with the drying device; the drying device comprises a drying device housing, a fan and a positive temperature coefficient (PTC) heater, a front end of the drying device housing is connected to the air outlet, and both of the PTC heater and the fan are electrically connected with the control system;

wherein the nursing machine further comprises a hose, a control line connected to the control system is provided in the hose, and the control line is connected to the PTC heater and the fan;

wherein an alternating current (AC) converter is provided on the main unit, and the AC converter is connected to the control line between the control system and the PTC heater.

2. A nursing machine comprising a main unit and an operating head, wherein the operating head comprises an inner bowl;

wherein the inner bowl comprises a bowl body, a bowl mouth is provided at a front portion of the bowl body;

wherein the nursing machine further comprises a hose, a tail end of the operating head is provided with a base, a first side and a second side of the base are each provided with a hook-shaped hanger, and a rear end face of the base is arranged with a polluted water port, a circuit port and a clean water port; a front end of the hose is connected to a plug, a first side and a second side of the plug are each provided with a hasp, and a front end face of the plug is provided with a polluted water joint, a circuit joint and a clean water joint.

* * * * *